US008911105B2

(12) United States Patent
Edmond et al.

(10) Patent No.: US 8,911,105 B2
(45) Date of Patent: Dec. 16, 2014

(54) LED LAMP WITH SHAPED LIGHT DISTRIBUTION

(71) Applicant: Cree, Inc., Durham, NC (US)

(72) Inventors: John Adam Edmond, Durham, NC (US); Christopher P. Hussell, Cary, NC (US)

(73) Assignee: Cree, Inc., Durham, NC (US)

( * ) Notice: Subject to any disclaimer, the term of this patent is extended or adjusted under 35 U.S.C. 154(b) by 40 days.

(21) Appl. No.: 13/666,094

(22) Filed: Nov. 1, 2012

(65) Prior Publication Data

US 2014/0119007 A1 May 1, 2014

(51) Int. Cl.
*F21V 1/00* (2006.01)
*F21V 13/02* (2006.01)

(52) U.S. Cl.
CPC ..... *F21V 13/02* (2013.01)
USPC ..... 362/235

(58) Field of Classification Search
USPC ..... 362/235
See application file for complete search history.

(56) References Cited

U.S. PATENT DOCUMENTS

| | | | | |
|---|---|---|---|---|
| 6,840,652 | B1 * | 1/2005 | Hymer | 362/235 |
| 7,213,940 | B1 | 5/2007 | Van De Ven et al. | |
| 7,999,283 | B2 | 8/2011 | Chakraborty et al. | |
| 8,004,172 | B2 | 8/2011 | Hussell et al. | |
| 8,376,562 | B2 * | 2/2013 | Osawa et al. | 362/95 |
| 2006/0034077 | A1 * | 2/2006 | Chang | 362/227 |
| 2009/0302730 | A1 | 12/2009 | Carroll et al. | |
| 2011/0075408 | A1 | 3/2011 | Negley et al. | |
| 2011/0255278 | A1 * | 10/2011 | Dassanayake et al. | 362/230 |
| 2011/0298355 | A1 | 12/2011 | Van De Ven | |
| 2012/0015114 | A1 * | 1/2012 | Yokoyama et al. | 428/1.1 |
| 2012/0057327 | A1 | 3/2012 | Le et al. | |
| 2012/0243230 | A1 * | 9/2012 | Carroll et al. | 362/249.02 |

FOREIGN PATENT DOCUMENTS

EP 2442009 * 4/2012 ..... F21S 2/00

OTHER PUBLICATIONS

Insignia LED Light Bulb, A Revolution in Lighting Technology, bestbuy.com, 2013.
Energy Star, Program Requirements for Integral LED Lamps, Mar. 22, 2010, pp. 1-30.
U.S. Appl. No. 13/649,052, filed Oct. 10, 2012.
U.S. Appl. No. 13/649,067, filed Oct. 10, 2012.
U.S. Appl. No. 13/018,013, filed Jan. 31, 2011.
U.S. Appl. No. 13/027,006, filed Feb. 14, 2011.
U.S. Appl. No. 13/112,502, filed May 20, 2011.
U.S. Appl. No. 13/178,791, filed Jul. 8, 2011.
U.S. Appl. No. 13/402,571, filed Sep. 23, 2011.
U.S. Appl. No. 61/712,585, filed Oct. 11, 2012.
U.S. Appl. No. 61/670,686, filed Jul. 12, 2012.

* cited by examiner

*Primary Examiner* — Evan Dzierzynski
(74) *Attorney, Agent, or Firm* — Dennis J. Williamson; Moore & Van Allen PLLC

(57) ABSTRACT

A lamp comprises an optically transmissive enclosure. A plurality of LEDs for emitting light are located to emit light toward the enclosure. The enclosure has at least one reflective area disposed on the enclosure to reflect a portion of the light into the enclosure to create a desired luminous intensity distribution.

19 Claims, 16 Drawing Sheets

LED LAMP WITH SHAPED LIGHT DISTRIBUTION

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. Since, ideally, an LED lamp designed as a replacement for a traditional incandescent or fluorescent light source needs to be self-contained; a power supply may be included in the lamp structure along with the LEDs or LED packages and the optical components. A heatsink is also often needed to cool the LEDs and/or power supply in order to maintain appropriate operating temperature.

SUMMARY OF THE INVENTION

In one embodiment a lamp comprises an optically transmissive enclosure. A plurality of LEDs for emitting light are disposed on mounts and face the interior of the enclosure. The enclosure has at least one reflective area.

The at least one reflective area may reflect light toward the interior of the enclosure. The enclosure may comprise a diffuser layer for scattering the light to produce a broad beam intensity profile. The diffuser layer may be applied over the entire enclosure. The at least one reflective area may comprise a reflective tape. The tape may comprise a pressure sensitive tape. The tape may comprise a reflective surface where the reflective surface faces the interior of the enclosure. The reflective area may be arranged such that the light intensity distribution of the bulb matches a desired light intensity distribution. The reflective area may comprise a first portion of the enclosure that is thicker than a second portion of the enclosure. The enclosure may be made of a molded plastic. The plastic may be acrylic. The reflective area may comprise an insert that is attached to the enclosure. The insert may be attached to the enclosure by one of adhesive, welding and a mechanical connection. The insert may be insert molded in the enclosure. The reflective area may be located at or near the 0 degree angle at the free end of the lamp. The reflective area may be located between the mounts. The reflective area may be located at the approximate 90 degree angle of the lamp.

The at least one reflective area may comprise a first reflective area that is located at or near the approximate 0 degree angle of the lamp and a second reflective area that is located at or near the approximate 90 degree angle of the lamp. Visible information may be provided by the at least one reflective area.

In one embodiment a lamp comprises an optically transmissive enclosure. A plurality of LEDs for emitting light are located to emit light toward the enclosure. The enclosure has at least one reflective area disposed on the enclosure to reflect a portion of the light into the enclosure to create a desired luminous intensity distribution.

DETAILED DESCRIPTION

Figure 1:
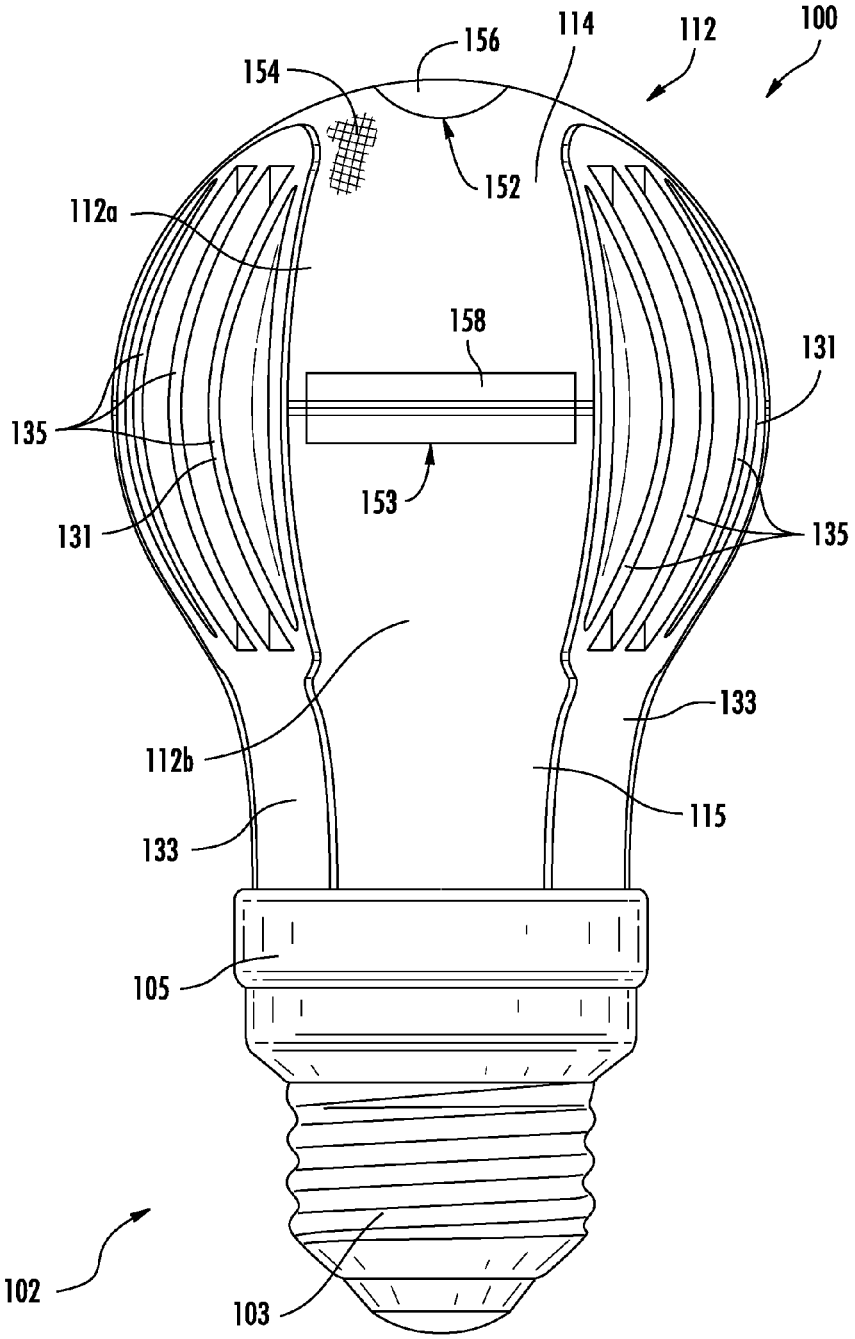
FIG. 1 is a plan view of an embodiment of a lamp of the invention.
Figure 2:
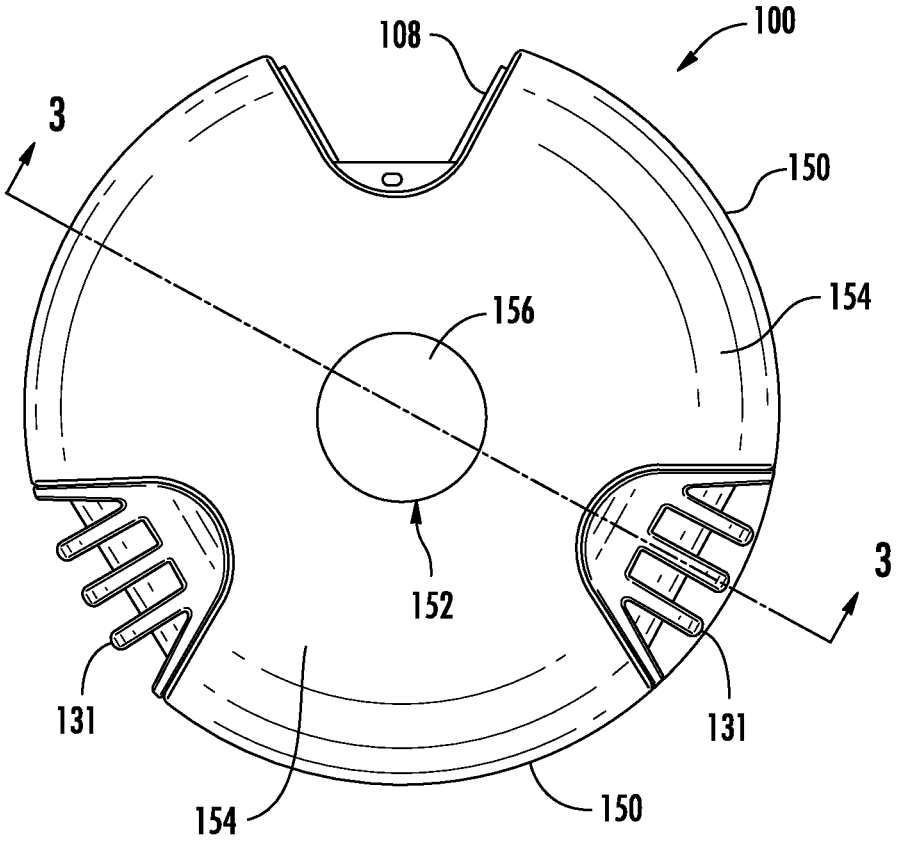
FIG. 2 is a top view of the lamp of FIG. 1 with one heat sink and LED assembly removed.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

FIGS. 1 through 5 show a lamp, 100, according to some embodiments of the present invention. Lamp 100 comprises a base 102 connected to an optically transmissive enclosure 112. Lamp 100 may be used as an A-series lamp with an Edison base 102, more particularly; lamp 100 is designed to serve as a solid-state replacement for an A19 incandescent bulb. The Edison base 102 as shown and described herein may be implemented through the use of an Edison connector 103 and a plastic form 105. LEDs 127 are mounted on substrates 129 and are operable to emit light when energized through an electrical connection. The substrates 129 support the individual LEDs or LED packages and in one embodiment comprise a PCB although the substrates may comprise other structures. In some embodiments, electrical circuitry may be provided on the substrates for powering the LEDs 127. While a lamp having the size and form factor of a standard-sized household incandescent bulb is shown, the lamp may have other the sizes and form factors.

Enclosure 112 is, in some embodiments, made of glass, quartz, borosilicate, silicate, polycarbonate, other plastic or other suitable material. The enclosure 112 may be of similar shape to that commonly used in household incandescent bulbs. It should also be noted that the enclosure 112 or a portion of the enclosure could be coated or impregnated with phosphor. The enclosure 112 may have a traditional bulb shape having a globe shaped main body 114 that tapers to a narrower neck 115. In one embodiment the enclosure may be made of a plastic such as acrylic. The enclosure 112 may be formed of an upper portion 112*a* and a lower portion 112*b* where the portions may be fit together to form the enclosure 112. The portions 112*a* and 112*b* may be joined by a friction fit, adhesive, mechanical engagement or other connection mechanism. In one embodiment, the enclosure 112 is formed with apertures 108 that receive the substrates 129 such that the LEDs 127 are disposed adjacent the wall of the enclosure 112 and project light inwardly toward the interior of the enclosure 112. The enclosure 112 may be transparent or translucent such that the light emitted into the interior of the enclosure, passes through the enclosure and is emitted from the enclosure.

A lamp base 102 such as an Edison base functions as the electrical connector to connect the lamp 100 to an electrical socket or other connector. Depending on the embodiment, other base configurations are possible to make the electrical connection such as other standard bases or non-traditional bases. Base 102 may include the electronics for powering lamp and may include a power supply and/or driver and form all or a portion of the electrical path between the mains and the LEDs. Base 102 may also include only part of the power supply circuitry while some components reside on the substrate. Electrical conductors 109 run between the LEDs 127 and the lamp base 102 to carry both sides of the supply to provide critical current to the LEDs 127.

The lamp 100 comprises a solid-state lamp comprising a plurality of LEDs 127. Multiple LEDs 127 can be used together. The LEDs 127 are mounted on the lamp on substrates 129 where each substrate typically supports a plurality of LEDs 127. For example, each substrate 129 may carry two, three or more LEDs 127. A plurality of substrates 129 are used that may be evenly spaced about the periphery of the enclosure 112. In the illustrated embodiment, three substrates 129 are used, each carrying three LEDs 127 creating a lamp having a total of nine LEDs connected in series. The substrates 129 provide the physical support for the LEDs 127 and properly position the LEDs in the openings 108 adjacent the enclosure 112. In some embodiments low voltage LEDs may be used. For example, three sets of three LEDs with each LED having a forward voltage of about 3 Volts may be used, and each set of LEDs is mounted on a separate substrate 129 and is connected in series for a total of 27 volts for the nine total LEDs 127 of lamp 100. In other embodiments, high voltage LEDs may be used using boost voltage converter technology to improve efficiency of the lamp 100, for example, nine high voltage LEDs with each LED having a forward voltage of 24 volts and connected in series can be used to operate at 216 Volts.

The substrates 129 are arranged such that the LEDs 127 are disposed about the periphery of the enclosure 112 at or near the enclosure and are positioned to direct light primarily inwardly toward the center of the enclosure. The substrates 129 may be mounted on arms 133 that extend from the base 102 and are evenly spaced about the perimeter of the enclosure 112 to support the substrates 129 in the openings 108. The substrates 129 may be in thermal and electrical connection with the base 102 such that an electrical connection is established between the base and the LEDs 127 mounted on the substrates 129. The base 102, substrates 129 and arms 133 may be separate components that are operatively connected to one another or portions of the base, substrates and arms may be made of one-piece. The substrates 129 and arms 133 may be considered mounts for the LEDs 127. The arms 133, substrates 127 and LEDs 127 may be evenly spaced about the periphery of the enclosure 112 such that the light projected from the LEDs 127 projects over an equal area of the enclosure 112. For example, in the illustrated embodiment three arms 133 are provided where each arm is disposed approximately 120 degrees from the adjacent arms such that each set of LEDs covers about 120 degrees of the enclosure 112. The sets of LEDs 127 are arranged such that the light emitted from each set of LEDs overlaps with the light emitted from the other sets of LEDs. As a result, while each set of LEDs is arranged to project light over one third of the bulb the light from the sets of LEDs overlaps to a large degree. While a lamp with three support arms and three sets of LEDs is shown, a greater or fewer number of arms and associated LEDs may be used. The LEDs may be arranged in a variety of patterns on the enclosure. For example, the LEDs may be formed as a ring extending around the center of the enclosure. One lamp is disclosed in United States Patent Application Publication Number US 2009/0302730, titled "LED-Based Light Bulb Device", which is incorporated by reference herein in its entirety.

The substrates 129 may be made of a thermally conductive material such that heat generated by the LEDs 127 is transferred to the exterior of the enclosure 112 via the substrate. Each substrate 129 may be thermally coupled to a heat sink structure 131 such that heat from the LEDs 127 is efficiently transferred to the exterior of the bulb. The heat sink structures 131 may be supported by the arms 133 and the arms and heat sink structure may be one-piece. Each substrate 129 may be connected to and supported by an arm 133 and heat sink structure 131. In such an arrangement the arms 133, substrates 129, and heat sink structures 131 may be considered the mounts for the LEDs 127. The heat sink structure 131 may comprise heat dissipating structures such as fins 135. Because the LEDs 127 may be attached directly to the substrate 129 and the substrate is thermally coupled to the heat sink structure 131, heat is transferred from the LEDs to the exterior of the bulb over a short thermal path. In some embodiments, the LEDs 127 are mounted directly on the heat sink or support structure 131 without an intervening substrate 129. In some embodiments, the substrate 129 and/or the heat sink structure can comprise a reflective coating, surface, layer and/or element on the mounting surface for the LEDs 127 and facing the interior of the enclosure 112 and/or on other surfaces of the substrate 129 and/or heat sink structure 131.

In one embodiment, the enclosure 112 and base 102 are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. In some embodiments, the LED lamp 100 may be equivalent to standard watt incandescent light bulbs.

The base 102 comprises an electrically conductive Edison screw 103 for connecting to an Edison socket and a housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

With respect to the features described above with various example embodiments of a lamp, the features can be combined in various ways. The LEDs 127 may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in as described herein. The LEDs 127 are operable to emit light when energized through an electrical connection. The LEDs 127 may comprise an LED die disposed in an encapsulant such as silicone, and LEDs which are encapsulated with a phosphor to provide local wavelength conversion, as will be described later when various options for creating white light are discussed. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used with the appropriate phosphor. LED devices can be used with phosphorized coatings packaged locally with the LEDs or with a phosphor coating the LED die as previously described. For example, blue-shifted yellow (BSY) LED devices, which typically include a local phosphor, can be used with a red phosphor to create substantially white light, or combined with red emitting LED devices in the array to create substantially white light. A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference.

Figure 6:
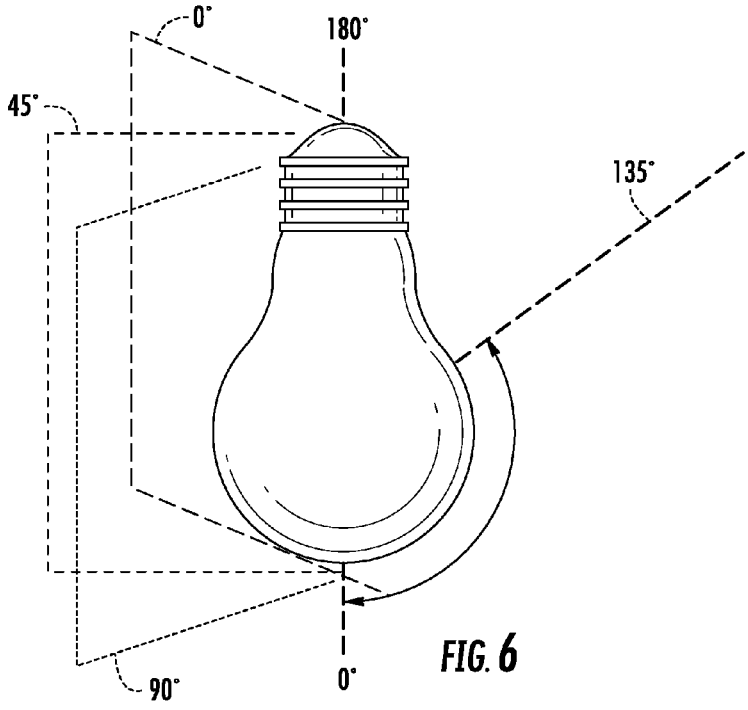
FIG. 6 is a diagram derived from the Energy Star® Partnership Agreement Requirements for Luminous Intensity Distribution.

In some embodiments, the light intensity distribution from the LEDs 127 may not correspond to a desired light intensity distribution. The lamp 100 of the invention uses discrete reflectors on the enclosure 112 to shape the light intensity distribution of the lamp 100 to match a desired light intensity distribution. While the desired light intensity distribution may comprise any light intensity distribution, in one embodiment the desired light intensity distribution conforms to the ENERGY STAR® Partnership Agreement Requirements for Luminous Intensity Distribution, which is incorporated herein by reference. For an omnidirectional lamp the Luminous Intensity Distribution is defined as "an even distribution of luminous intensity (candelas) within the 0° to 135° zone (vertically axially symmetrical). Luminous intensity at any angle within this zone shall not differ from the mean luminous intensity for the entire 0° to 135° zone by more than 20%. At least 5% of total flux (lumens) must be emitted in the 135°-180° zone. Distribution shall be vertically symmetrical as measures in three vertical planes at 0°, 45°, and 90°." FIG. 6 is a diagram useful in explaining the luminous intensity distribution described above and is taken from the "ENERGY STAR® Program Requirements for Integral LED Lamps" which is incorporated herein by reference. As shown in FIG. 6, the free end of the enclosure 112, opposite to the base, is considered 0° and the base of the lamp is considered 180°. As defined in the standard, luminous intensity is measured from 0° to 135° where the measurements are repeated in vertical planes at 0°, 45° and 90°.

Figure 7:
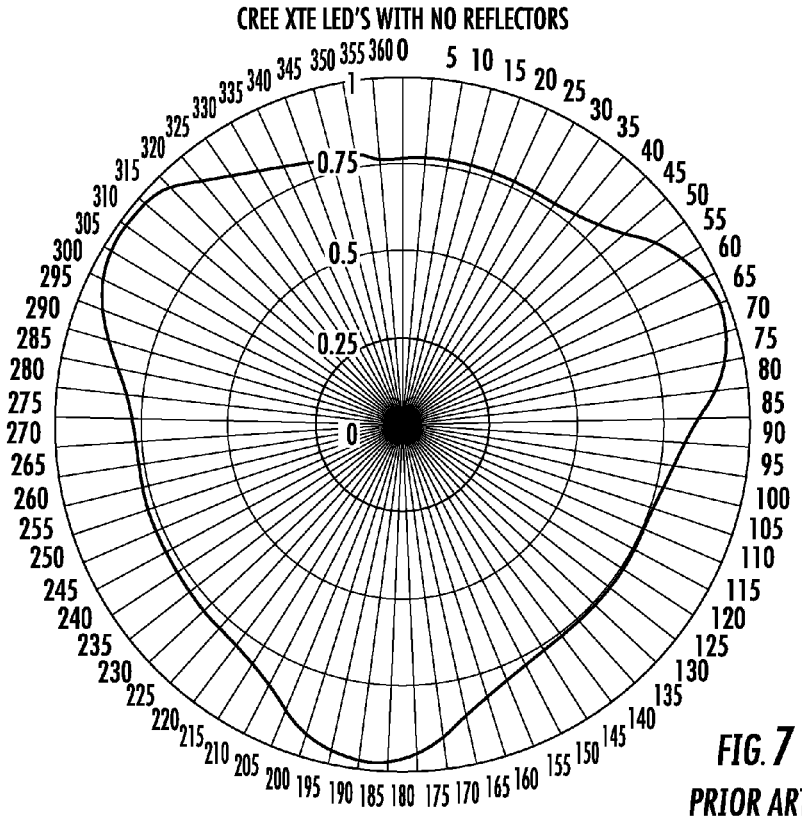
FIG. 7 PRIOR ART
FIG. 7 is a light distribution intensity pattern of a prior art lamp.

The structure and operation of lamp 100 of the invention will be described with specific reference to the ENERGY STAR® standard set forth above; however, the use of the discrete reflectors as described herein may be used to create other light intensity distribution patterns. FIG. 7 shows the light distribution of a bulb as shown and described with reference to FIGS. 1 through 5 using CREE Inc. XT-E™ LEDs without the use of the discrete reflectors disclosed herein. FIG. 7 shows graphically the light intensity distribution of a lamp when viewed along its longitudinal axis (from the bottom as shown in FIG. 6). As is evident from FIG. 7 the light distribution pattern has a somewhat triangular shape where maximum light intensity is found at approximately 70°, 190° and 310°. Minimum light intensities are found at, for example, approximately 15°, 135°, and 270°. The light intensity is greatest at the free end 0° of the bulb and at the positions approximately directly opposite the LEDs 127 and is at a minimum at a position directly behind the arms 133, LEDs 127 and heat sink structures 131. This result may be due in part to the light distribution from the LEDs as well as the light blocking effect of the heat sink structures 131, arms 133 and substrates 129. Ideally the intensity distribution of the lamp would be circular about the vertical axis of the bulb for an omnidirectional bulb.

Figure 8:
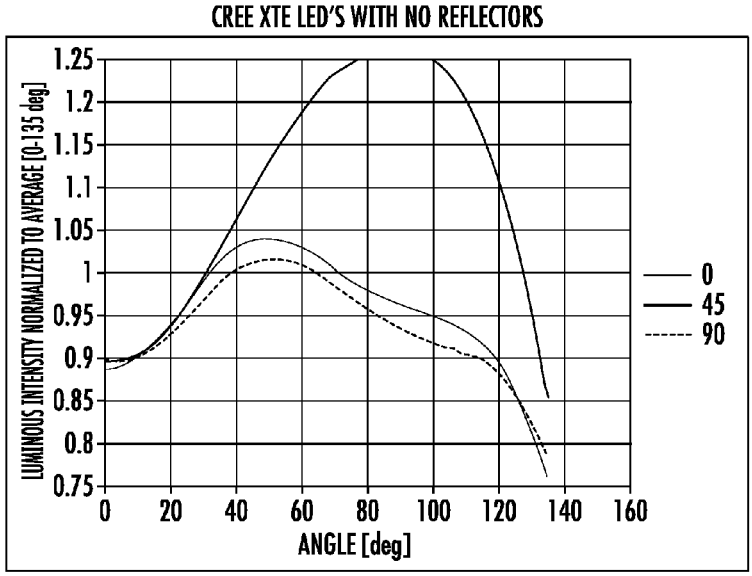
FIG. 8 PRIOR ART
FIG. 8 is a graph of the luminous intensity distribution associated with the intensity pattern of FIG. 7 for the same prior art lamp.

FIG. 8 is a graph of the luminous intensity distribution for the lamp of FIG. 7 that does not use the discrete reflectors disclosed herein. The graph shows on the x-axis the angles from 0 degrees to 135 degrees as measured in the zones defined by the vertical planes at 0°, 45°, and 90°. The y-axis shows the luminous intensity normalized. As set forth in the ENERGY STAR® standard "luminous intensity at any angle within this zone shall not differ from the mean luminous intensity for the entire 0° to 135° zone by more than 20%." The 20% variance from the mean luminous intensity is shown in heavy lines at 1.2 and 0.8 where the mean intensity has been normalized to 1. Thus, to be ENERGY STAR® compliant the curves of all of the lines must be between 0.8 and 1.2 between 0 degrees and 135 degrees. Referring to FIG. 8, at 0° (the free end of the bulb) measurements at each of the planes is approximately 0.9. Between 60 and 110 degrees the value of the luminous intensity in the 45 degree plane is over the upper limit of 1.2. The lines for 0 and 90 degree planes are below the lower limit of 0.8 between approximately 120 and 135 degrees. Such a bulb would not be ENERGY STAR® compliant.

Figure 9:
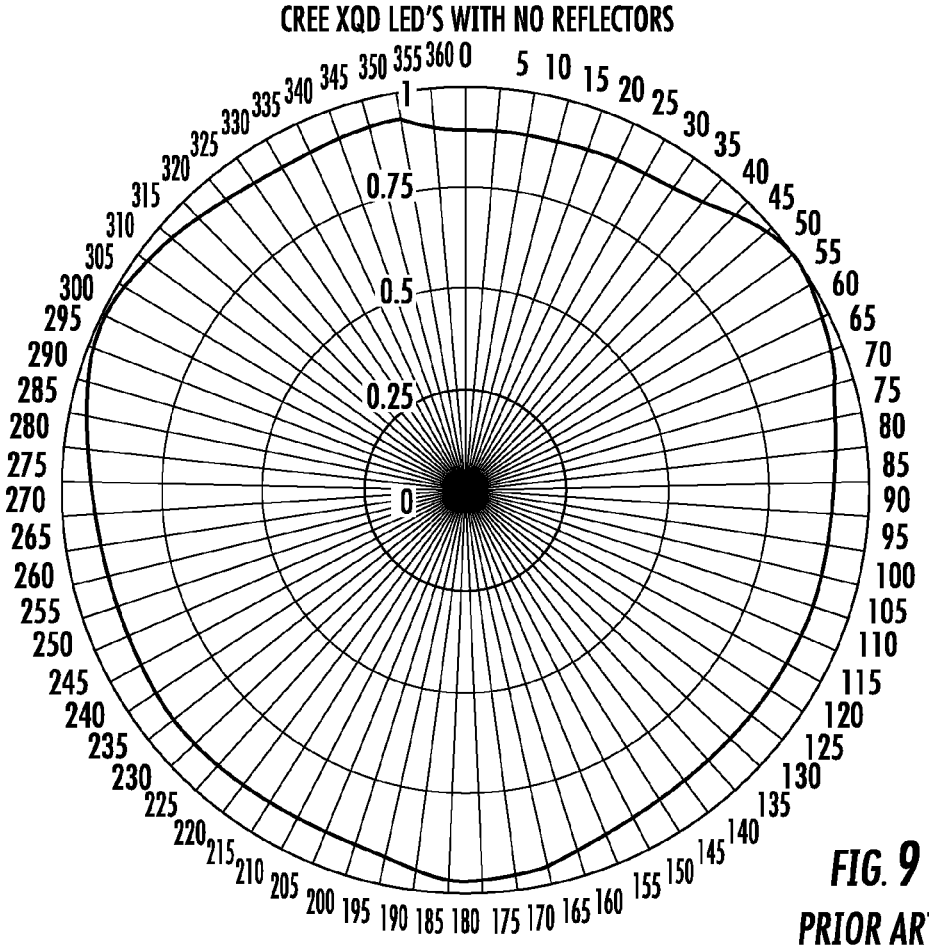
FIG. 9 PRIOR ART
FIG. 9 is a light distribution intensity pattern of another prior art lamp.

FIG. 9 shows the light distribution of a bulb as shown and described with reference to FIGS. 1 through 5 using CREE Inc. XQD™ LEDs without the use of the discrete reflectors disclosed herein. FIG. 9 shows graphically the light intensity distribution of a lamp when viewed along its longitudinal axis (from the bottom as shown in FIG. 6). As is evident from FIG. 9 the light distribution pattern has a more rounded shape than the device of FIGS. 7 and 8 because of the use of different LEDs. The maximum light intensity is found at approximately 55°, 190° and 30°. Minimum light intensities are found between these maximums. The light intensity is greatest at the free end 0° angle of the lamp and at the positions approximately directly opposite the LEDs 127 and is at a minimum at the positions directly behind the arms 133, LEDs 127 and heat sink structures 131. As previously explained, this result may be due in part to the light distribution from the LEDs as well as the light blocking effect of the heat sink structures 131, arms 133 and substrates 129.

Figure 10:
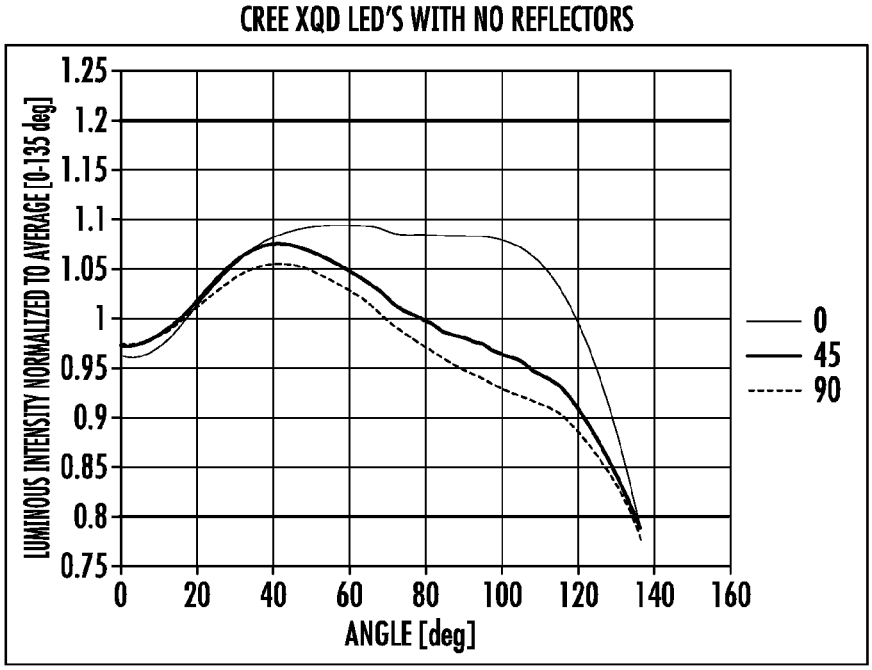
FIG. 10 PRIOR ART
FIG. 10 is a graph of the luminous intensity distribution associated with the intensity pattern of FIG. 9 for the same prior art lamp.

FIG. 10 is a graph of the luminous intensity distribution for the lamp of FIG. 9 that does not use the discrete reflectors disclosed herein. The graph shows on the x-axis the angles from 0 degrees to 135 degrees as measured in the zones defined by the vertical planes at 0°, 45°, and 90°. The y-axis shows the luminous intensity normalized. To be Energy Star compliant the curves of all of the lines must be between 0.8 and 1.2 between 0 degrees and 135 degrees. Referring to FIG. 10, all of the lines are below the lower limit of 0.8 near 135 degrees.

The luminous intensity distribution may be varied by altering the light pattern emitted by the lamp by providing the enclosure 112 with discrete reflectors that shift the emitted light to create a desired light intensity distribution. Referring again to FIGS. 1-5, the enclosure 112 has at least a first area or areas 152 that have a first reflector 156. The enclosure may also have a second area or areas 153 that have a second reflector 158. The enclosure may have reflectors located at different areas from those shown in the figures. Depending on the embodiment, a single and/or multiple reflectors and/or reflective regions can be positioned on and/or in enclosure 112 outside of the substrates 129 and/or support or heat sink structure 131 (if present) to obtain a desired light distribution pattern.

In some embodiments, the enclosure 112 may have a diffuser layer 154 that scatters the light passing through the enclosure to produce a broad beam intensity profile. The diffuser layer may be transparent, semi-transparent, or translucent. In one embodiment, a uniform diffuser layer 154 may be applied to the entire surface of the enclosure 112. In some embodiments, the enclosure 112 is coated on the inside with silica, alumina, titanium dioxide, or other particulate to provide a diffuser scattering layer 154 that produces a more uniform far field pattern. The enclosure 112 may also be etched, frosted or coated. The enclosure may also have the diffuser layer 154 formed as a part of the enclosure rather than applied to the enclosure. For example, the enclosure 112 may be made of a plastic such as acrylic or borosilicate glass where the enclosure material has light scattering properties. The diffuser layer 154 may also comprise a film or coating over the enclosure. One such approach to applying a diffuser layer to a bulb is disclosed in U.S. Patent Application Pub. No. 2012/0057327 which is incorporated herein by reference in its entirety.

Selected areas 152, 153 of the enclosure are provided with reflective surfaces such that some of the light that would otherwise pass through the enclosure in these areas is reflected and redirected such that it is emitted from the enclosure at a different location. The reflective surfaces may be provided by any material or construction that can reflect light and vary the luminous intensity distribution of the light photons passing through the enclosure 112. The diffuser layer 154 may be applied to the entire surface of the enclosure 112 and the reflectors 156, 158 may be applied over the diffuser layer, or the diffuser layer 154 may not be applied in those areas where the reflectors 156, 158 are applied. Different reflective materials may be used in different locations such that the different discrete reflectors reflect light differently While in some embodiments the reflectors are highly reflective and prevent most of the light from passing through the reflective surface, in some embodiments the reflectors may be diffuse reflectors that reflect a portion of the light but allow some light to be diffused or scattered. The reflectors are selectively applied to the enclosure such that the pattern or distribution of light from the enclosure is modified from or is different than the pattern or distribution of light from the enclosure without the reflectors.

Figure 3:
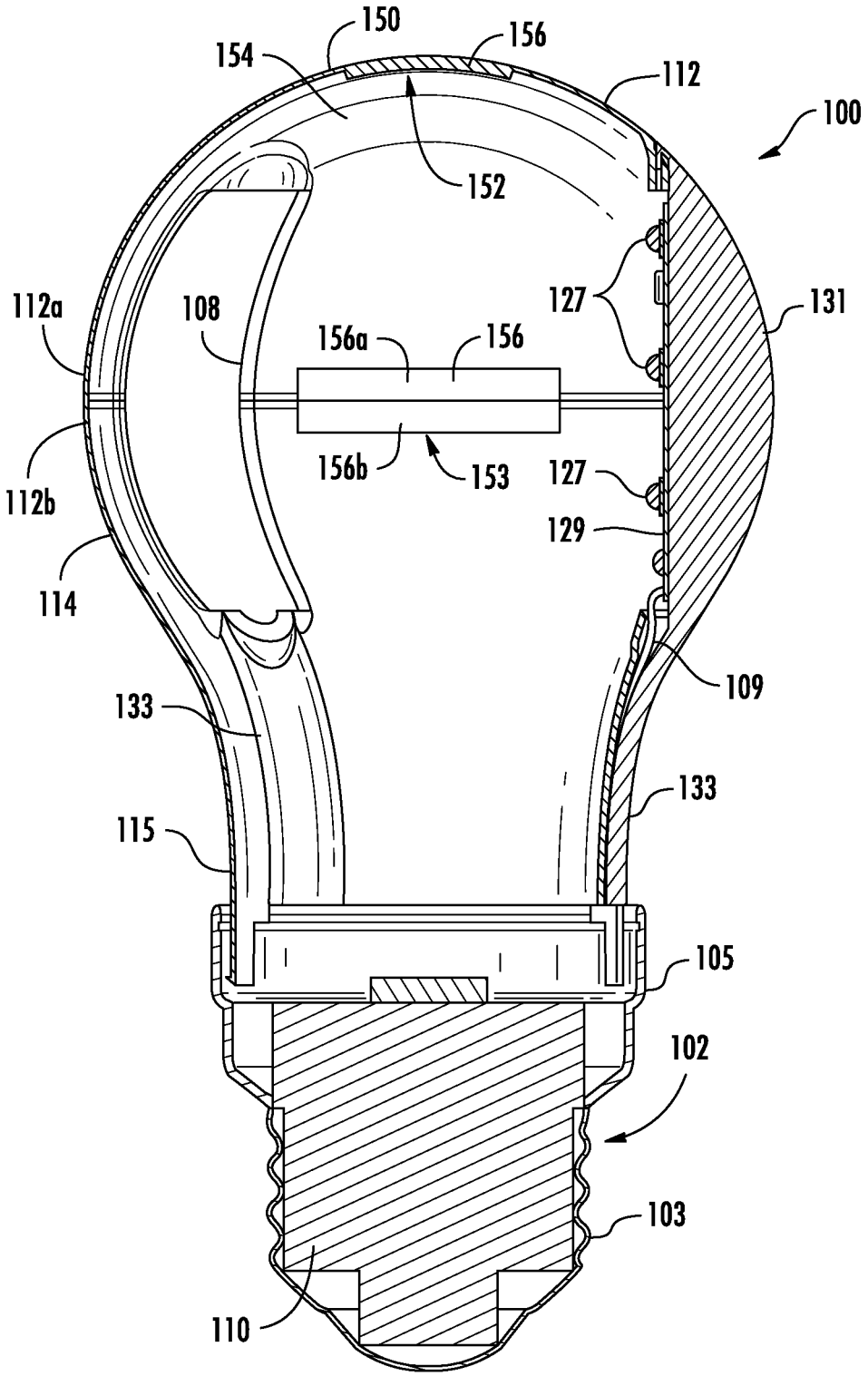
FIG. 3 is a section view taken along line 3-3 of FIG. 2.
Figure 4:
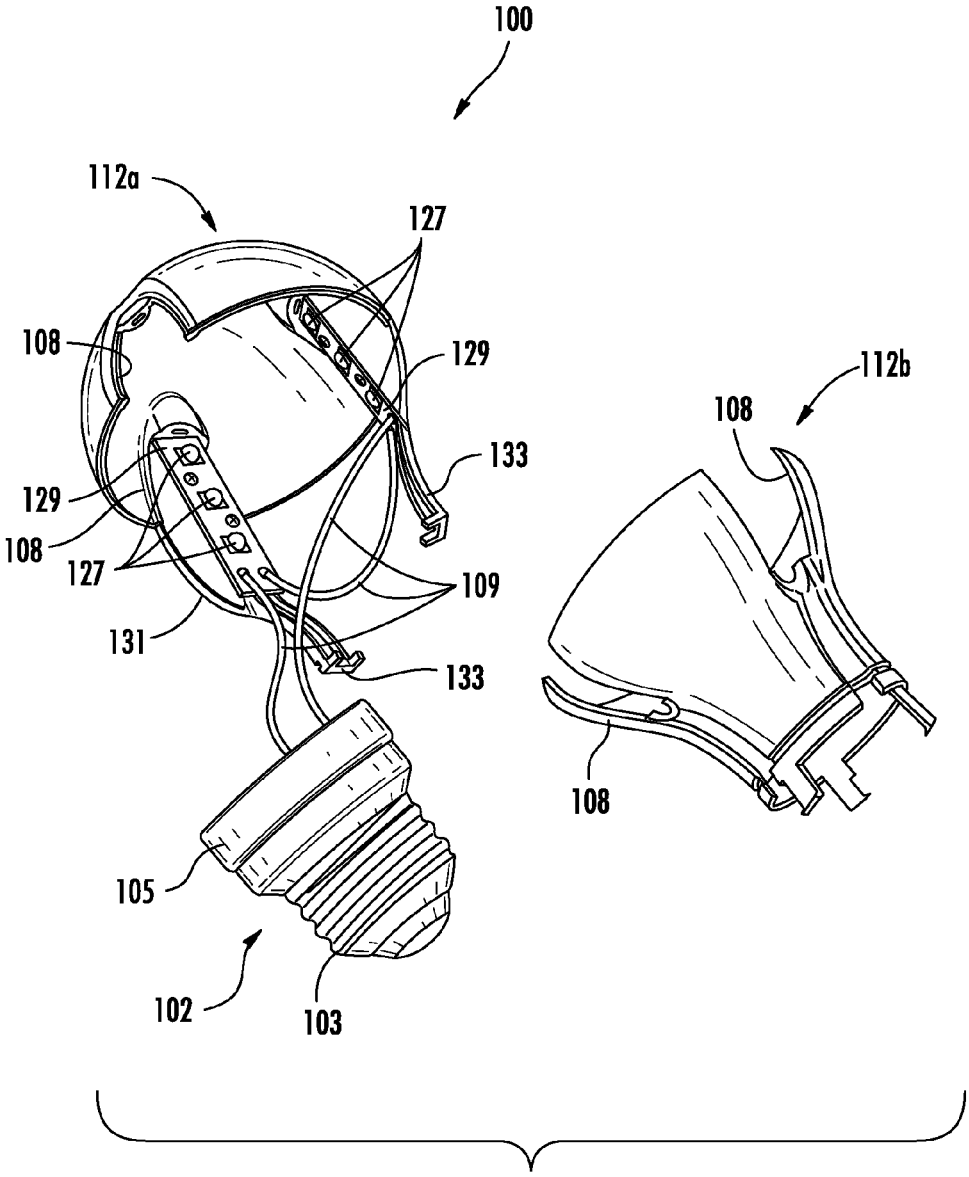
FIG. 4 is an exploded view of a lamp of FIG. 1.

In one embodiment, the reflectors 156, 158 may be provided by a tape or film. The reflectors 156, 158 may be provided by a pressure sensitive tape that is applied to selected areas 152, 153 of the enclosure 112 to obtain a desired intensity distribution. The tape may comprise a white optic material having an adhesive on one side where the white optic material faces the interior of the enclosure. The tape may be attached to the inside surface of the enclosure 112 at selected locations. The locations are selected such that the luminous intensity distribution of the bulb matches a desired luminous intensity distribution. To facilitate assembly of the lamp, the areas 152, 153 may be indicated on the enclosure 112 by guides or the like molded into the enclosure. The reflectors may also be applied to the external surface of the enclosure 112. The reflectors may be provided by two or more pieces of tape that together combine to make one area of the enclosure reflective. Such an arrangement may be particularly beneficial where the reflector is positioned at or near the 90° mark of the lamp where the first enclosure portion 112*a* meets the second enclosure portion 112*b* as shown in FIG. 3. Using two pieces of tape 156*a* and 156*b* or two other reflectors, one applied along the edge of portion 112*a* and the other applied along the edge of portion 112*b* allows the reflector to span the seam between the two portions in the assembled lamp.

Figure 11:
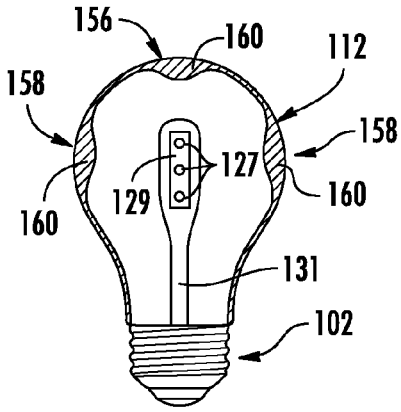
FIGS. 11 through 16 are section views showing alternate embodiments of the lamp of the invention.

In another embodiment, the reflectors 156, 158 may be provided by thickened portions 160 of the enclosure 112 as shown in FIG. 11. Where a molded plastic enclosure is used, the enclosure 112 may be molded such that in the area or areas where the reflectors 156, 158 are provided, the wall thickness of the enclosure 112 is greater compared to the rest of the enclosure 112 such that the thicker wall portions reflect the light back toward the interior of the enclosure. Varying the thickness of the enclosure 112 may also be accomplished with a glass enclosure.

Figure 12:
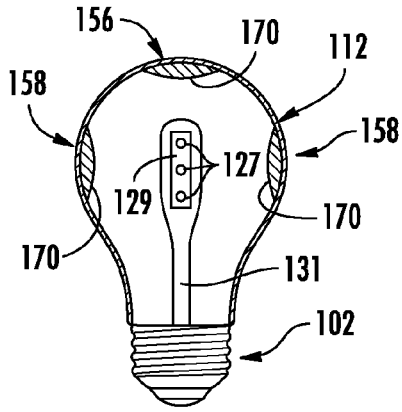

The reflectors may also comprise a reflective coating 170 applied to the surface of the enclosure 112 as shown in FIG. 12. Different types of coatings may be applied to the different areas of the reflectors to change the reflectance of those areas. In other embodiments, reflective material or particles is impregnated into or integrated with the enclosure 112.

Figure 13:
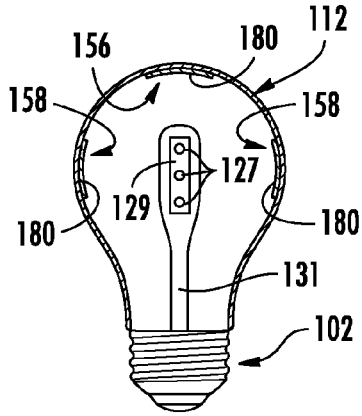
Figure 14:
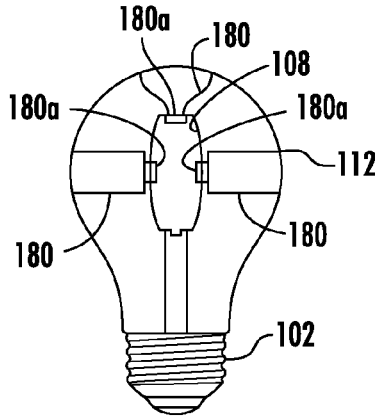
Figure 15:
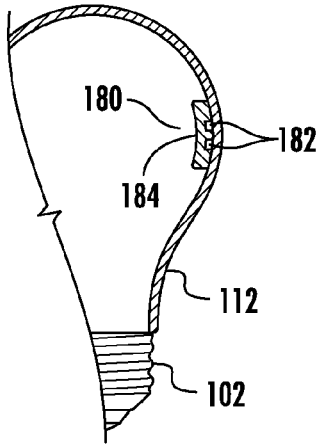
Figure 16:
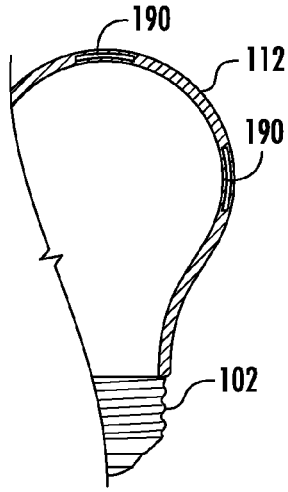

In yet another embodiment, the reflectors 156, 158 may be provided by an insert 180 that is attached to the enclosure 112 as shown in FIG. 13. The reflectors 156, 158 may be provided by a separate inserts 180 that are mounted to the enclosure 112 or other components so as to cover the reflective areas of the enclosure. In one embodiment, the insert 180 is secured on the inside of the enclosure 112, although the insert may be attached to the outside surface of the enclosure if desired. The insert may be attached to the enclosure by adhesive, welding or a mechanical connection. In one embodiment of a mechanical connection, the insert 180 may be secured to the enclosure 112 by retaining a portion 180*a* of the insert 180 that is held between other components of the bulb as shown in FIG. 14. For example, the insert 180 may span the openings 108 and include retaining portions 180*a* that are trapped between, for example, the enclosure 112 and the arms 133 and/or heat sink structure 131. The retaining portions 180*a* of the insert 180 may also be trapped between the enclosure portions 112*a* and 112*b*. Connectors may also be molded into the enclosure 112 which are engaged by mating connectors on the insert 180. For example, the enclosure 112 may comprise female receptacles or male engagement members 182 that receive mating male engagement members or female receptacles 184 formed on the insert 180 as shown in FIG. 15. The engagement members may be retained in the receptacles by a friction fit, mechanical engagement, adhesive and/or the like. Moreover, the mating connectors may be formed on the fingers 133, heat sink 131 or substrates 129 rather than on the enclosure 112. The reflectors 156, 158 may also comprise a reflective insert 190 that is insert molded into the enclosure 112 during molding of the plastic enclosure as shown in FIG. 16.

A wide variety of materials may be used to provide the reflective surfaces. The reflectors may be applied to the interior surface or the exterior surface of the enclosure. Moreover, the reflective material may be incorporated into the enclosure material. The reflectors may comprise a white optic material, plastic, PET, MCPET or other similar material that is secured to the enclosure 112 or other components. In some embodiments, the reflective material may be highly reflective and reflect at least 98% of the light. MCPET is a highly reflective plastic with such a reflectivity. In other embodiments, the reflective material may reflect over 95% of the light. PET is an example of a highly reflective plastic with such a reflectivity. In other embodiments the reflective material may reflect 90% of the light, and the material may be plastic, metal or other reflective material. The terms reflector and reflective material as used herein mean a structure or material that is predominantly reflective and may include diffuse reflectors that reflect a predominant portion of the light but scatter or diffuse another portion of the light. The thicknesses of the reflectors in the drawings are not to scale in order to more clearly show the reflective structures. Moreover, while particular areas of the enclosure 112 are shown as having the reflectors, the reflectors may be located at any location and in any area of the enclosure that advantageously reflects the light to obtain a desired luminous intensity distribution.

Figure 17:
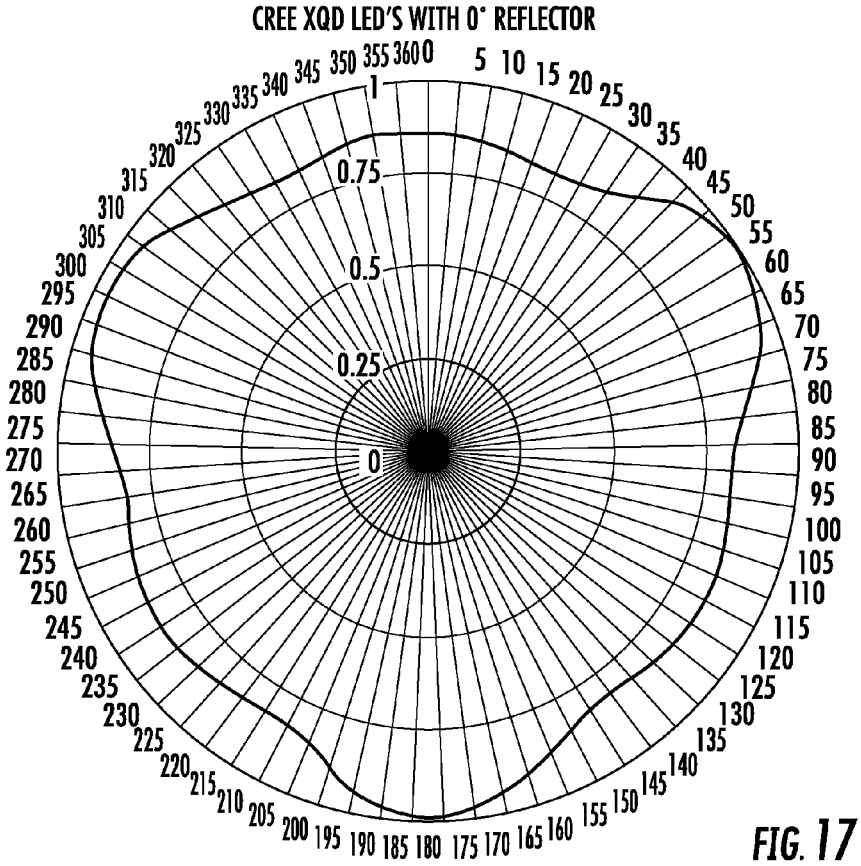
FIG. 17 is a light distribution intensity pattern of an embodiment of a lamp of the invention.
Figure 18:
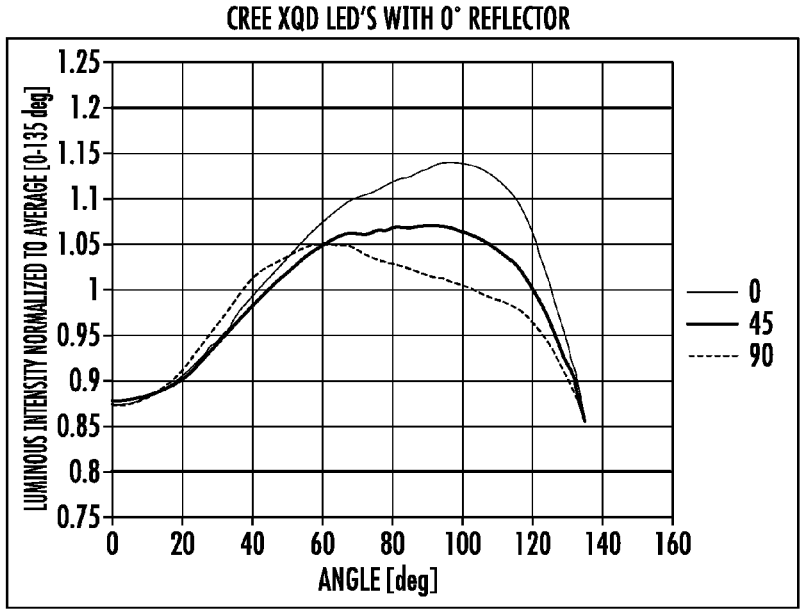
FIG. 18 is a graph of the luminous intensity distribution associated with the intensity pattern of FIG. 17 for the same lamp.

In one embodiment, it has been found that applying a reflector 156 located on or near the 0 degree area 152 at the free end of the bulb (FIG. 26) advantageously alters the intensity distribution of the bulb. In a lamp constructed as described herein using XQD™ LEDs manufactured by CREE, Inc. it has been found that providing a reflector positioned at or near the 0 degree area of the lamp provides a lamp that falls within the Energy Star range. CREE XQD LEDs are described in U.S. patent application Ser. No. 13/649,052 filed on Oct. 10, 2012 which is incorporated by reference in its entirety, and U.S. patent application Ser. No. 13/649,067 filed on Oct. 10, 2012 which is incorporated by reference in its entirety. As previously explained, FIGS. 9 and 10 graphically show the luminous intensity of a lamp constructed using CREE XQD LEDs without any reflectors. FIGS. 17 and 18 graphically show the luminous intensity of a lamp constructed as described herein using CREE XQD LEDs with a reflector located on the 0 degree area 152 of the lamp. As shown in FIG. 18, the lines for the 0°, 45° and 90° planes at or near 135° all terminate above the bottom range for ENERGY STAR® compliance. Locating a reflector at or near the 0 degree area of the lamp reflects some of the light that would otherwise exit the top of the enclosure 112 toward the base 102. This is evident when comparing FIGS. 10 and 18 as the intensity at 0° is lowered from between 0.95 and 1.0 (FIG. 10) to between 0.85 and 0.9 (FIG. 18) while the intensity near the base (135°) for all three planes is raised from below 0.8 (FIG. 10) to between 0.85 and 0.9 (FIG. 18). Thus, light is shifted from a higher intensity area to a lower intensity area to bring all of the light distribution to within a desired range.

Reflectors may be placed on the enclosure to shift light exiting the enclosure where light is selectively shifted from a higher intensity area to a lower intensity area. The light does not necessarily have to be shifted from the highest intensity areas of the distribution provided that any area from which light is reflected does not fall below a desired minimum. For example, in the preceding example, light was shifted or reflected from the 0° area of the enclosure even though this area was not the peak area, compare FIGS. 8 and 16. Moreover, while in the foregoing example the desired light distribution corresponds to the ENERGY STAR® luminous intensity distribution requirements, the desired light intensity distribution may be any desired light intensity distribution.

The reflector 156 may define a circular area centered on the 0 degree area of the bulb as shown in the figures. While a circular area is shown, the area may have a variety of shapes and sizes including irregular shapes. Moreover, the reflector need not be positioned on or centered on the exact 0 degree area provided sufficient light is reflected to create the desired pattern. For example, reflectors may surround the 0 degree point but not cover this point. Moreover, the reflector may be annular in shape or have apertures that allow some light to pass. The shape of the reflector may vary from the specific examples shown in the drawings; however, in some embodiments the aesthetics of the bulb may be considered such that the reflectors are shaped to provide an aesthetically pleasing pattern and/or shape to the user. In one embodiment, tape may be applied in area 152 to create the reflector 156.

Figure 5:
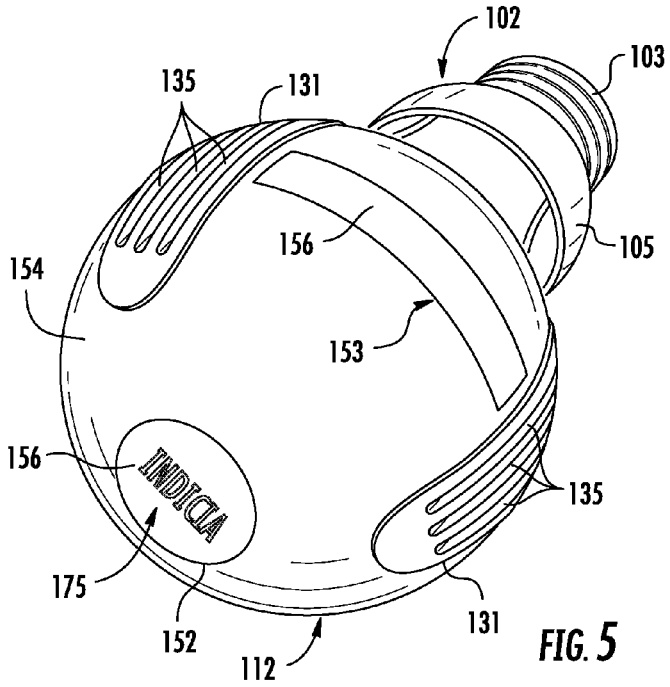
FIG. 5 is a perspective view of the lamp of FIG. 1.

The reflector may also be used to provide information to a user as shown in FIG. 5. For example, the color of the exposed surface of the reflector (the side of the reflector visible from outside of the enclosure) may have information printed on the reflector or otherwise be visible. For example, the reflector may include words, pictures, or other indicia 175 that provide information to the user such as bulb color, wattage or the like. The indicia 175 may also display logos or trademarks. The information may also be conveyed by the color or shape of the reflector. For example, the color of the visible exposed side of the reflector may be color coded to the emitted light, e.g. a cream color to represent soft white, a pure white color to represent bright white light and/or other colors. Additionally, information such as a logo, trademark or lamp data and/or other indicia may be formed on the enclosure 112 where the reflector is positioned behind the information to provide a contrasting color or background to the information that may be used to enhance visibility or readability of the information.

Figure 21:
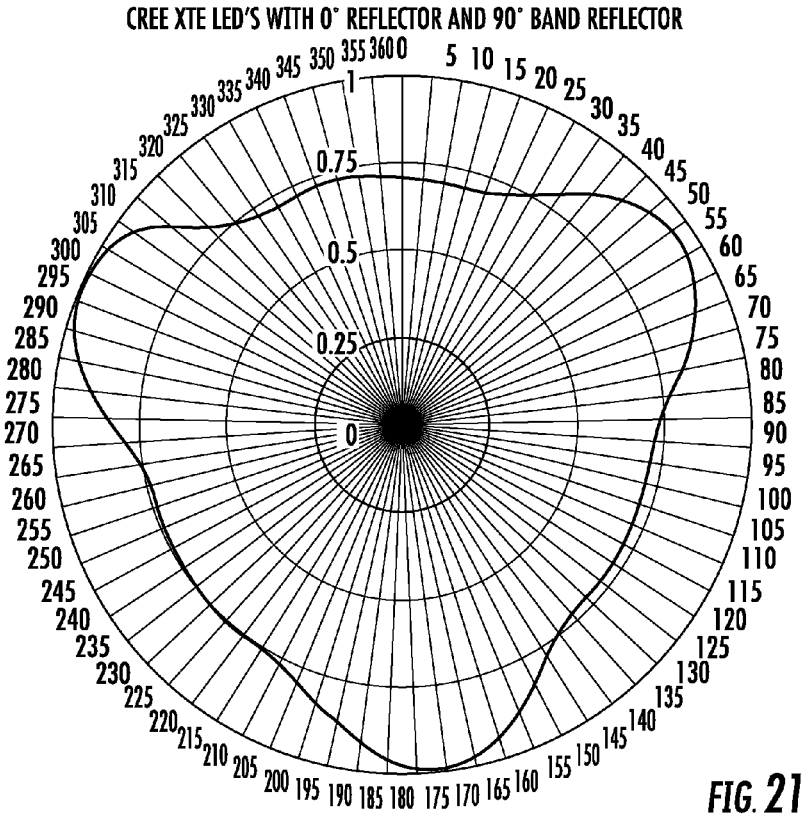
FIG. 21 is a light distribution intensity pattern of yet another embodiment of a lamp of the invention.
Figure 22:
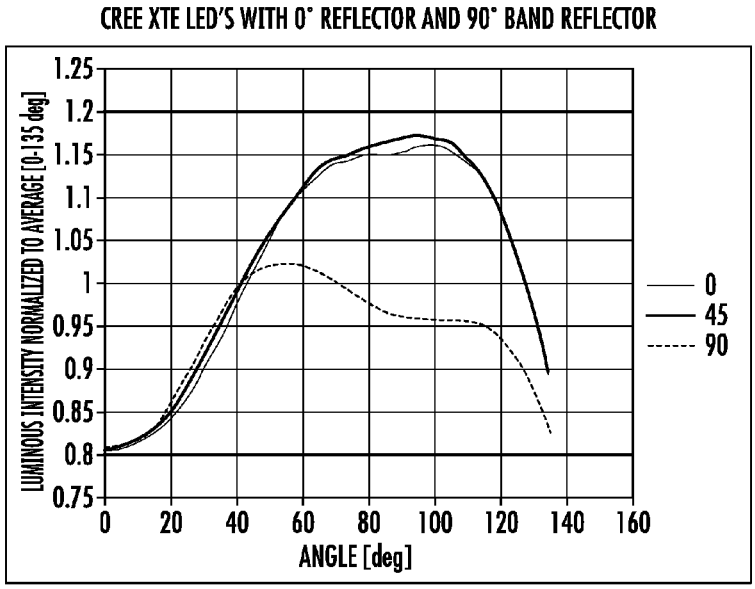
FIG. 22 is a graph of the luminous intensity distribution associated with the intensity pattern of FIG. 21 for the same lamp

The reflectors may be disposed between the mounts for the LEDs such as arms 133, substrates 129 and heat sink structures 131. In one embodiment the reflectors 156 are located in areas 153 that extend about the periphery of the bulb, between the mounts, at the approximate 90 degree angle. While the reflectors 158 are shown as substantially rectilinear the reflectors may be of different shapes and sizes to those shown in the figures. In one embodiment, it has been found that positioning a reflector 156 at or near the 0 degree area 152 and reflectors 156 positioned in areas 153 that extend about the periphery of the bulb at the approximate 90 degree angle advantageously alters the intensity distribution of the bulb. In the example embodiment, the reflectors 156 are approximately 3.5 mm wide. In a lamp constructed as described herein using XT-E™ LEDs manufactured by CREE, Inc. it has been found that providing a reflector positioned at or near the 0 degree area of the lamp and reflectors 156 positioned in areas 153 that extend about the periphery of the bulb at the approximate 90 degree angle provides a lamp that falls within the Energy Star range. CREE XT-E LEDs are described in U.S. patent application Ser. No. 13/018,013 filed on Jan. 31, 2011 which is incorporated by reference in its entirety, U.S. patent application Ser. No. 13/027,006 filed on Feb. 14, 2011 which is incorporated by reference in its entirety, U.S. patent application Ser. No. 13/112,502 filed on May 20, 2011 which is incorporated by reference in its entirety, U.S. patent application Ser. No. 13/178,791 filed on Jul. 8, 2011 which is incorporated by reference in its entirety, and U.S. patent application Ser. No. 13/402,571 filed on Sep. 23, 2011 which is incorporated by reference in its entirety. Referring to FIGS. 21 and 22 the illustrated graphs show luminous intensity of a lamp constructed using CREE XT-E LEDs with a reflector located on the 0 degree area of the lamp and reflectors positioned about the periphery of the bulb at the approximate 90 degree angle as illustrated in FIGS. 1-5. As shown in FIG. 22, at the lines for the 0°, 45° and 90° planes all extend between the top and bottom ranges for ENERGY STAR® compliance. Locating the reflector at or near the 0 degree area of the lamp reflects some of the light that would otherwise exit the top of the enclosure toward the base 102 and the band located at approximately 90 degrees reflects some of the light at the 90 degree angle back into the enclosure. This is evident when comparing FIG. 22 to FIG. 8 as the intensity at 0° is lowered from about 0.9 (FIG. 8) to just above 0.8 (FIG. 22), the intensity near the base (135°) for all three planes is raised from below 0.8 (FIG. 8) to above 0.8 (FIG. 22), and the intensity near the 90 degree angle for the 45 degree plane is lowered from well outside the upper limit (FIG. 8) to below 1.2 (FIG. 22). Thus, light is shifted from a higher intensity area to a lower intensity area to bring all of the light distribution to within the desired range.

Figure 19:
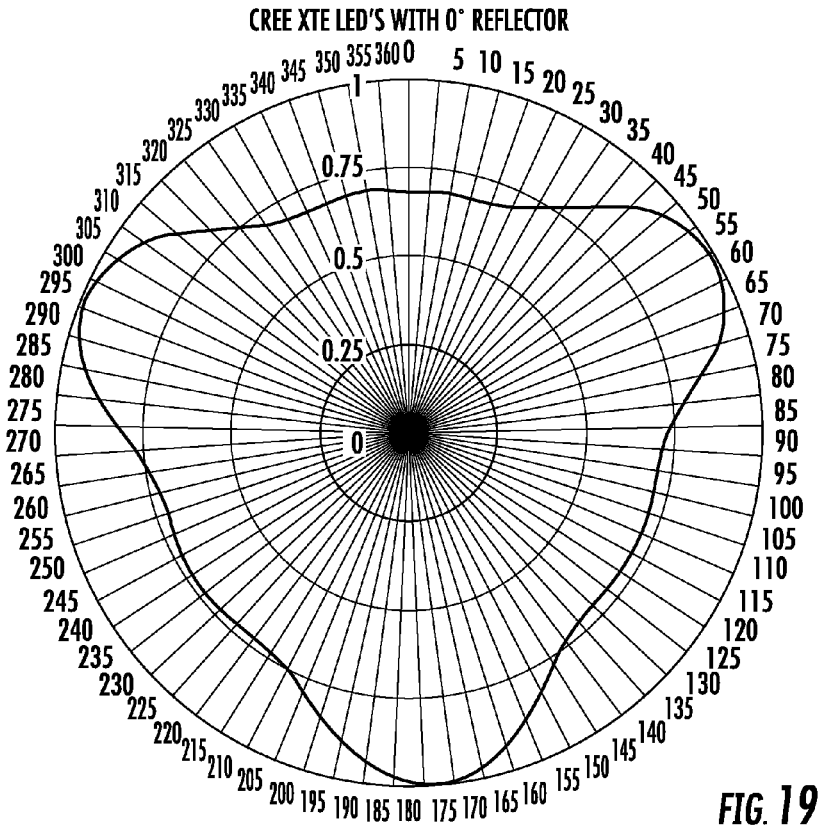
FIG. 19 is a light distribution intensity pattern of another embodiment of a lamp of the invention.
Figure 20:
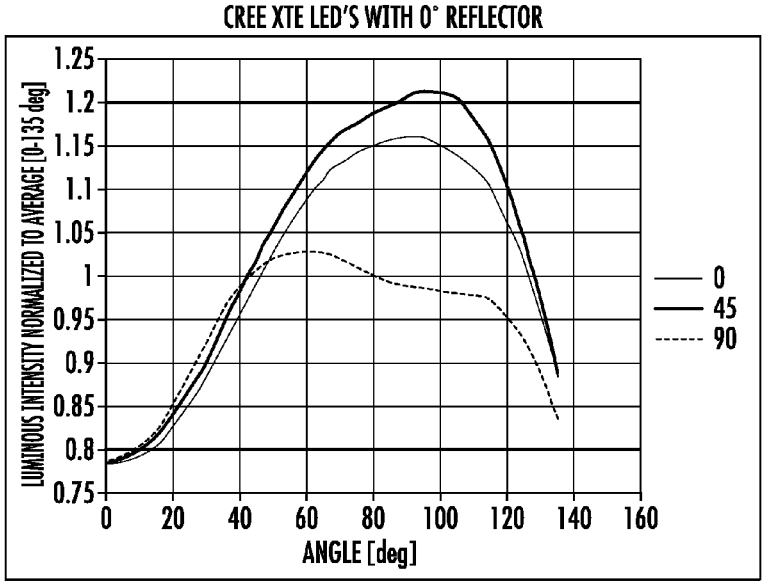
FIG. 20 is a graph of the luminous intensity distribution associated with the intensity pattern of FIG. 19 for the same lamp.
Figure 26:
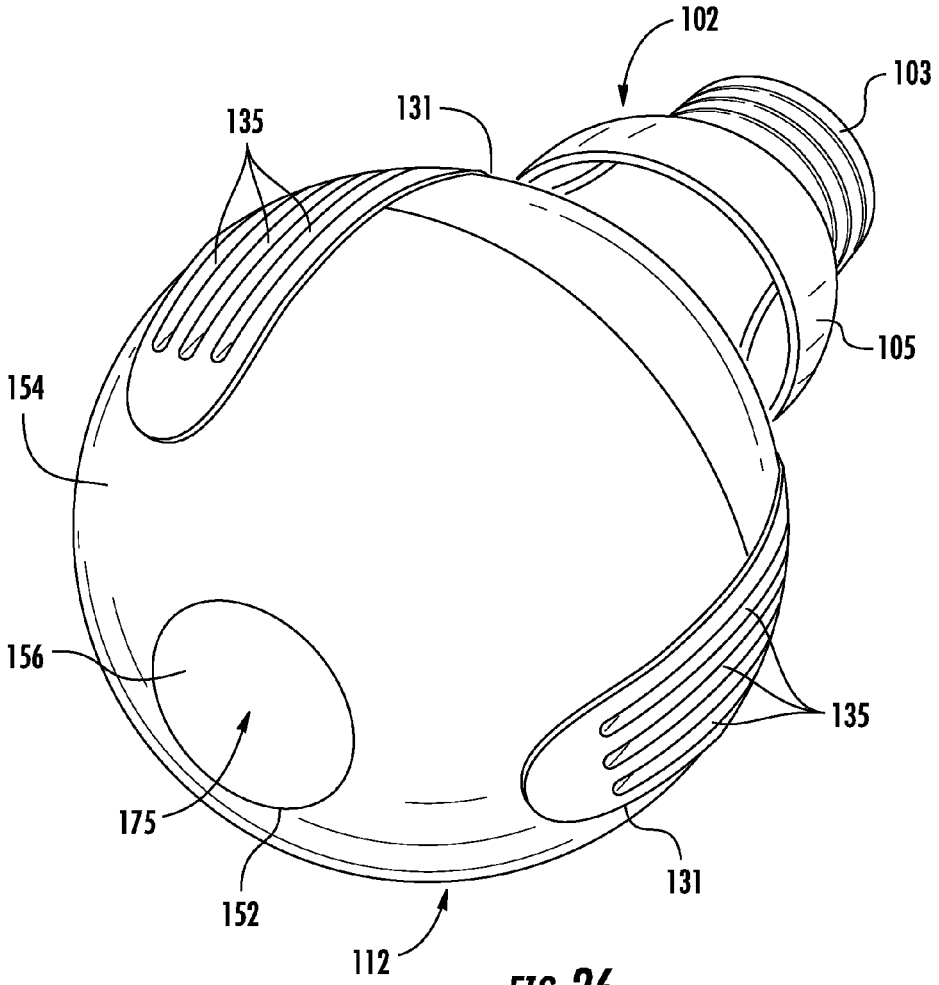
FIG. 26 is a perspective view of an alternate embodiment of the lamp of the invention.

As a comparison, FIGS. 19 and 20 show the luminous intensity for a lamp constructed as previously describe with respect to FIGS. 21 and 22 except that the reflector located in a band about the periphery of the lamp at the approximate 90 degree angle has been eliminated such that only the reflector located on the 0 degree area of the lamp is used (see FIG. 26). Comparing FIG. 20 to FIG. 22 and FIG. 8 shows that using only the reflector located on the 0 degree area of the lamp improves the performance of the lamp over the device of FIG. 8 but does not bring the lamp into ENERGY STAR® compliance like the lamp of FIG. 22. This example is provided to illustrate how various arrangements of the reflectors may be used to shape the luminous intensity distribution. While the lamp of FIG. 20 is not Energy Star compliant it still may be a desired luminous distribution in some applications.

Figure 23:
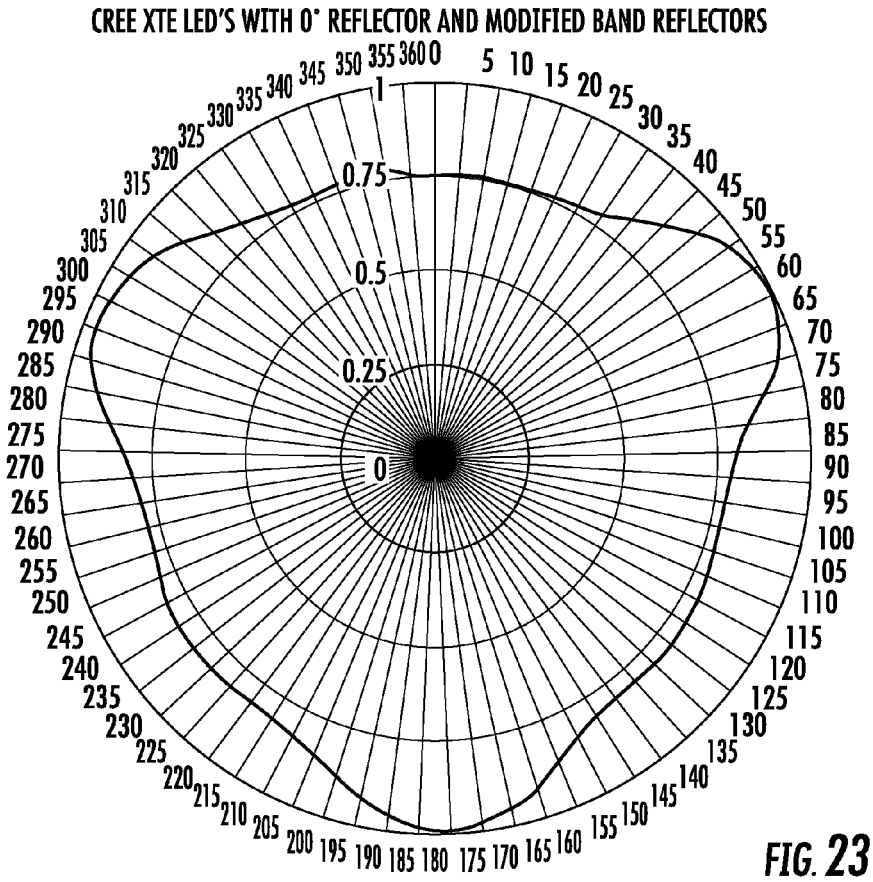
FIG. 23 is a light distribution intensity pattern of still another embodiment of a lamp of the invention.
Figure 24:
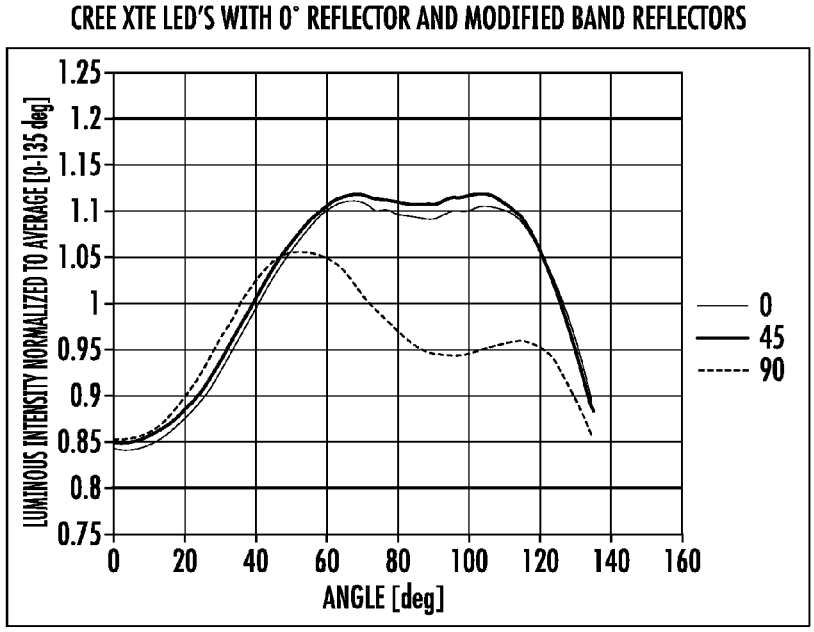
FIG. 24 is a graph of the luminous intensity distribution associated with the intensity pattern of FIG. 23 for the same lamp

As a further comparison, FIGS. 23 and 24 show the luminous intensity for a lamp constructed as previously describe with respect to FIGS. 21 and 22 except that the reflector located in a band about the periphery of the lamp is centered on the seam of the lamp and is twice as wide as the band described with respect to FIGS. 21 and 22. Comparing FIG. 24 to FIG. 22 and FIG. 8 shows that using the modified band brings the lamp into Energy Star compliance like the lamp of FIG. 22 but provides a greater intensity at 0 degrees and lower intensity at 90 degrees. This example is also provided to illustrate how various arrangements of the reflectors may be used to shape the luminous intensity distribution.

The shape of the luminous intensity of a lamp may be modified in a variety of ways by changing the location, size, shape and reflectivity of the reflectors. The precise deployment of the reflectors is determined by the desired luminous intensity distribution and may vary from the specific embodiments described herein. The arrangement and structure of the reflectors on the enclosure 112 is based in part on the desired light distribution and in part on the light pattern that is projected by the LEDs. The location, number, size and shape of the reflectors are determined such that the light intensity distribution is modified from the light intensity distribution generated by the LEDs and enclosure to a desired light intensity distribution. The areas selected in some embodiments may be those areas where the peaks occur on the luminous intensity distribution. In other embodiments the reflectors may be located where some portion of the light may be redirected without falling below the desired light intensity distribution but that are not peaks. Because the reflectors may be located anywhere on the enclosure the reflectors may be oriented such that light is directed from a first location on the enclosure toward a desired second location to increase the light intensity at the second location or more locations and/or to reduce the light intensity in the first location.

Figure 25:
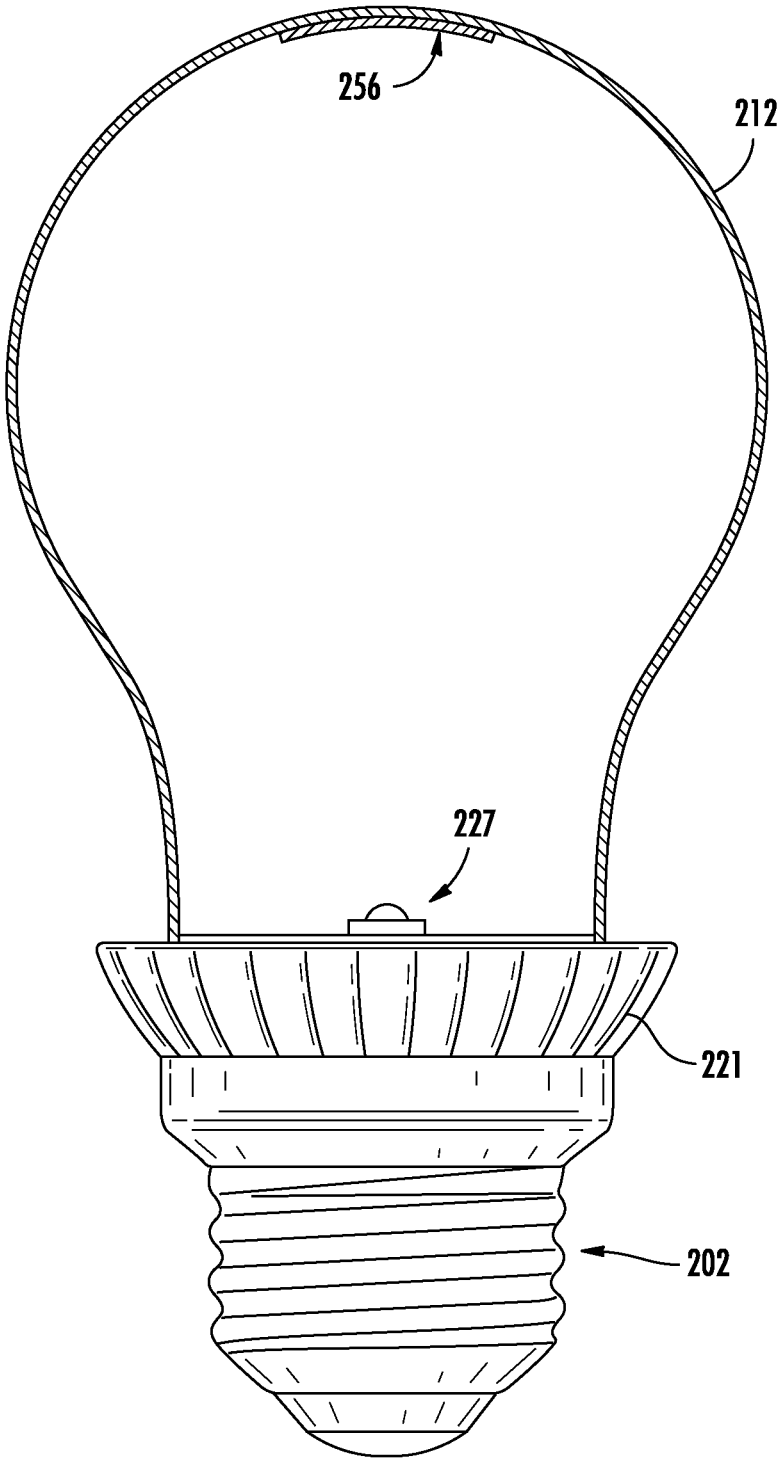
FIG. 25 is a view of an alternate embodiment of a lamp according to the invention.
Figure 27:
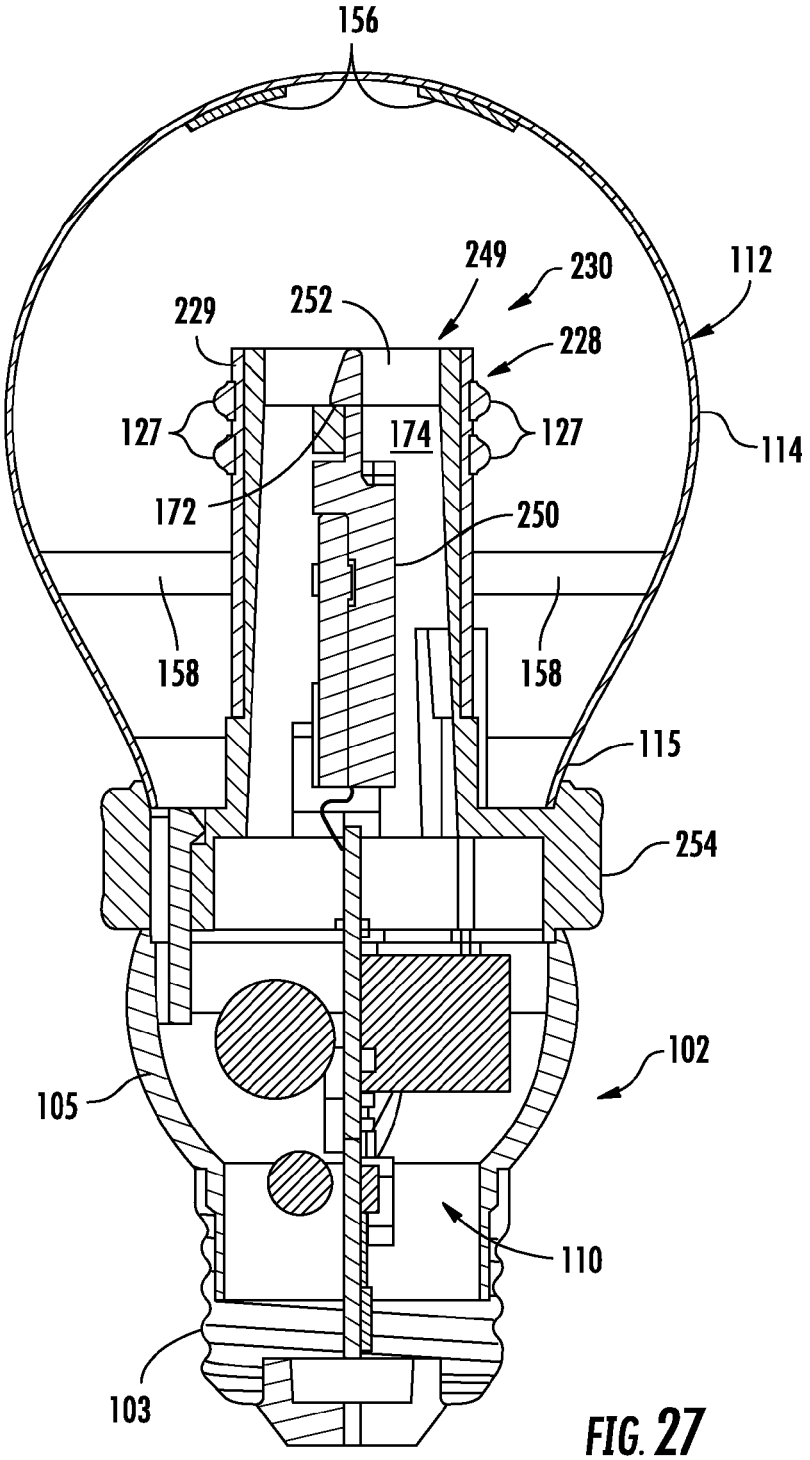
FIG. 27 is a section view showing another embodiment of the invention.
Figure 28:
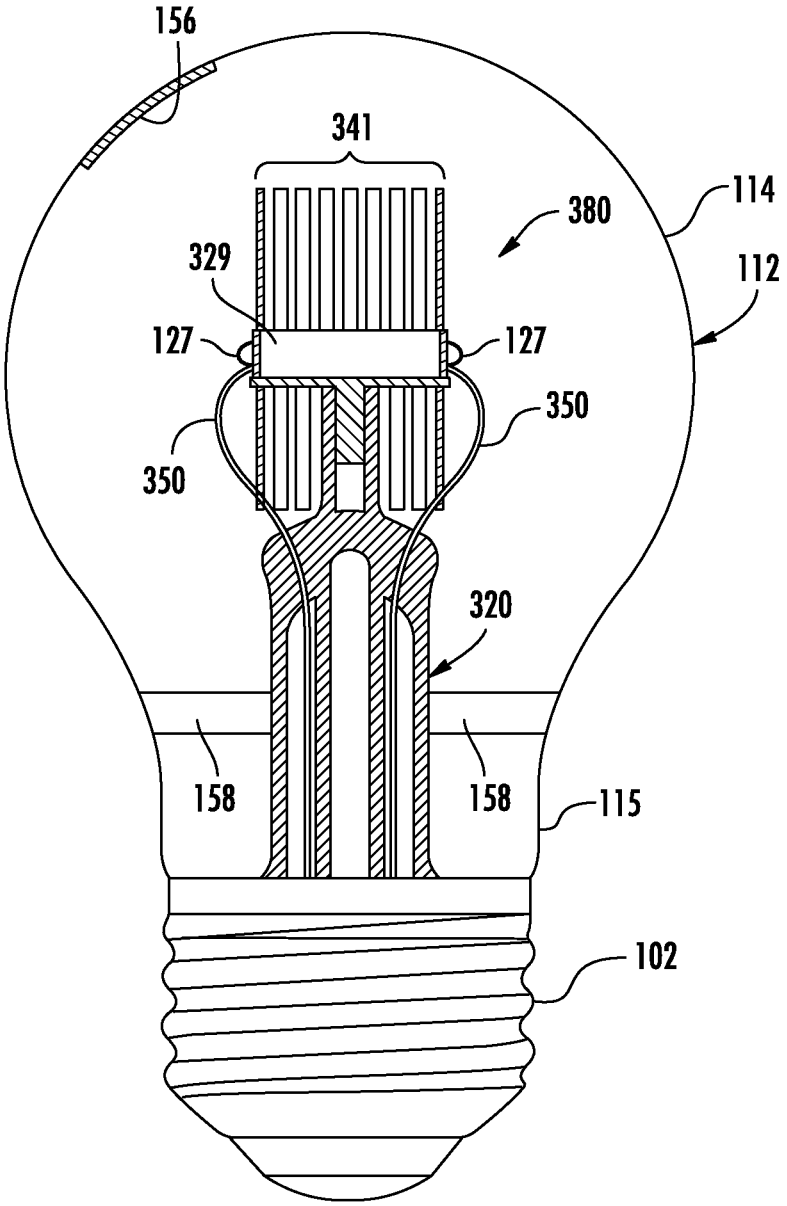
FIG. 28 is a section view showing still another embodiment of the invention.

Referring to FIG. 25 a lamp 200 is shown where the LED 227 (or plurality of LEDs) is mounted at or near the base 202 of the lamp such that light is emitted from a central location within the lamp toward the enclosure 212. A heat sink 221 may be provided near the base 202 to dissipate heat from the LEDs. Reflectors as described herein may be used to create a desired light intensity distribution in such a lamp design. For example, a reflector or reflectors 256 may be located on the enclosure 212 near the free end of the enclosure at or near the 0 degree angle generally opposite to the LEDs 227. The reflector 256 may be used to reflect a portion of the light toward the base 202 such that the light intensity near the base is increased. Such an arrangement may be advantageously used to increase the light intensity near the base of an omnidirectional lamp. In other embodiments, the LEDs 127 are mounted on a tower within the enclosure 112 pointing outward towards the enclosure as described in pending U.S. Provisional Patent Application Ser. No. 61/712,585, filed on Oct. 11, 2012, titled LED Lamp which is incorporated by reference herein in its entirety, and U.S. Provisional Patent Application Ser. No. 61/670,686, filed on Jul. 12, 2012, titled Gas Cooled LED Lamp which is incorporated by reference herein in its entirety. One such embodiment is shown in FIG. 27 and comprises an LED assembly 230 comprising a submount 229 arranged such that the LED array 228 is substantially in the center of the enclosure 112 such that the LED's 127 are positioned at the approximate center of enclosure 112 and project light toward the enclosure. As used herein the term "center of the enclosure" refers to the vertical position of the LEDs in the enclosure as being aligned with the approximate largest diameter area of the globe shaped main body 114. In one embodiment, the LED array 228 is arranged in the approximate location that the filament is disposed in a standard incandescent bulb. The LED assembly 230 may be mounted to the heat sink structure 249 by an electrical interconnect 250 where the electrical interconnect 250 provides the electrical connection between the LED assembly 230 and the lamp electronics 110. The heat sink structure 149 comprises a heat conducting portion 252 and a heat dissipating portion 254. Another embodiment of a lamp is shown in FIG. 28 and comprises a solid-state lamp comprising a LED assembly 330 with light emitting LEDs 127. Multiple LEDs 127 can be used together, forming an LED array. The LEDs 127 can be mounted on or fixed within the lamp in various ways. The LEDs 127 may be mounted on multiple sides of submount 329 and are operable to emit light when energized through an electrical connection. Wires 350 run between the submount 329 and the lamp base 102 to carry both sides of the supply to provide critical current to the LEDs 127. A heat sink structure 341 may also be provided. The LED assembly 330 also may be physically supported by a glass stem 320. The LED assembly 330 may also be supported by separate support wires that are fused into the glass stem 320 and are connected to the LED. The LED's 127 are positioned at the approximate center of enclosure 112. As used herein the term "center of the enclosure" refers to the vertical position of the LEDs in the enclosure as being aligned with the approximate largest diameter area of the globe shaped main body 114. In one embodiment, the LED array 228 is arranged in the approximate location that the filament is disposed in a standard incandescent bulb. In the embodiments of FIGS. 27 and 28 reflectors 156 and 158 are provided at various locations on the enclosure 112 to modify the light distribution pattern as previously described. The reflectors may have various shapes and sizes and may comprise circular dots or bands that extend around or partially around the periphery of the enclosure 112. The bands and dots may have a variety of shapes and may have irregular shapes or regular shapes such as, but not limited to, circular, rectangular, oval, or the like.

In the embodiments described herein and in other embodiments the LEDs may have a variety of orientations in the enclosure. The LEDs may be arranged such that they are facing upwardly, downwardly, laterally or at other angles relative to the lamp. The angle of the LEDs, their location and the arrangement of the reflector as described herein may be used to change the light distribution pattern of a lamp. The reflectors described herein may also be used with other lamp designs to modify the light intensity distribution as previously described.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an optically transmissive enclosure;

a base connected to the optically transmissive enclosure;

a plurality of LEDs for emitting light disposed on at least one mount and facing the interior of the enclosure, the plurality of LEDs emitting light when energized through an electrical path from the base;

at least one reflective area spaced from the base and provided on the optically transmissive enclosure wherein the at least one reflective area comprises a reflective tape that is at least approximately 90% light reflective.

2. The lamp of claim 1 where the at least one reflective area reflects light toward the interior of the enclosure.

3. The lamp of claim 1 where the enclosure comprises a diffuser layer for scattering the light to produce a broad beam intensity profile.

4. The lamp of claim 3 wherein the diffuser layer is applied over the entire enclosure.

5. The lamp of claim 1 wherein the reflective tape comprises a pressure sensitive tape.

6. The lamp of claim 1 wherein the reflective tape comprises a reflective surface, the reflective surface facing the interior of the enclosure.

7. The lamp of claim 1 wherein the at least one reflective area is arranged such that the light intensity distribution of the lamp matches a desired light intensity distribution.

8. The lamp of claim 1 wherein the at least one reflective area comprises an insert that is attached to the enclosure.

9. The lamp of claim 8 wherein the insert is attached to the enclosure by one of adhesive, welding and a mechanical connection.

10. The lamp of claim 8 wherein the insert is insert molded in the enclosure.

11. The lamp of claim 1 wherein the at least one reflective area is located at or near the 0 degree angle at the free end of the lamp.

12. The lamp of claim 1 wherein the at least one mount comprises at least a first mount and a second mount and the at least one reflective area is located between the first mount and the second mount.

13. The lamp of claim 12 wherein the at least one reflective area is located at the approximate 90 degree angle of the lamp.

14. The lamp of claim 1 wherein the at least one reflective area comprises a first reflective area is located at or near the approximate 0 degree angle of the lamp and a second reflective area located at or near the approximate 90 degree angle of the lamp.

15. The lamp of claim 1 wherein visible indicia is provided on the at least one reflective area.

16. A lamp comprising:

an optically transmissive enclosure;

a plurality of LEDs for emitting light toward the enclosure;

the enclosure having at least one reflective area disposed on or within the enclosure to reflect a portion of the light into the enclosure to create a desired luminous intensity distribution wherein a first one of the at least one reflective area is surrounded by the optically transmissive enclosure, the first one of the reflective area being at least approximately 90% light reflective over the entire reflective area.

17. A lamp comprising:

an optically transmissive enclosure;

a base connected to the optically transmissive enclosure;

a plurality of LEDs for emitting light disposed on at least one mount and facing the interior of the enclosure, the plurality of LEDs emitting light when energized through an electrical path from the base;

at least one reflective area spaced from the base and provided on the optically transmissive enclosure wherein the at least one reflective area comprises a first portion of the enclosure that is thicker than a second portion of the enclosure.

18. The lamp of claim 17 wherein the enclosure is made of a molded plastic.

19. The lamp of claim 18 wherein the plastic is made of acrylic.

* * * * *